US005897025A

United States Patent [19]

Flewitt et al.

[11] Patent Number: 5,897,025

[45] Date of Patent: Apr. 27, 1999

[54] TABLET DISPENSER

[75] Inventors: Harry Flewitt, Farnham; Wendy Johnson; Stephen Barnet Lewis, both of London, all of United Kingdom

[73] Assignee: SmithKline Beecham plc., Brentford, United Kingdom

[21] Appl. No.: 08/836,538

[22] PCT Filed: Nov. 15, 1995

[86] PCT No.: PCT/EP95/04514

§ 371 Date: Oct. 22, 1997

§ 102(e) Date: Oct. 22, 1997

[87] PCT Pub. No.: WO96/15959

PCT Pub. Date: May 30, 1996

[30] Foreign Application Priority Data

Nov. 19, 1994 [GB] United Kingdom ..... 9423389

[51] Int. Cl.[6] ..... B65G 59/00

[52] U.S. Cl. ..... 221/257; 221/263; 206/537

[58] Field of Search ..... 221/263, 268, 221/232, 256, 257, 186, 312 R, 303, 255; 206/537, 535, 536

[56] References Cited

U.S. PATENT DOCUMENTS

| | | | |
|---|---|---|---|
| 2,918,167 | 12/1959 | Lowen | 206/540 |
| 2,962,190 | 11/1960 | Horland | 221/202 |
| 3,968,902 | 7/1976 | Bachmann | 221/263 |
| 5,174,471 | 12/1992 | Kozlowski et al. | 221/256 |

*Primary Examiner*—Kenneth Noland

*Attorney, Agent, or Firm*—Dara L. Dinner; Stephen Venetianer

[57] ABSTRACT

A container for dispensing tablets in which the dispensing opening and/or a dispensing passage upstream of the dispensing opening is constricted such that a tablet is releasably retained with part of the tablet projecting outside of the dispensing opening. The part of the rim of the dispensing opening or an adjacent part of the container is movable relative to the rest of the container so as to facilitate the release of the retained tablet from the container.

10 Claims, 4 Drawing Sheets

TABLET DISPENSER

This invention relates to a novel container for containing and dispensing tablets.

Many products, e.g. pharmaceuticals, confectionery etc. are supplied in the form of solid tablets contained in a container, e.g. a bottle, jar or case, from which they are dispensed. Usually such tablets are dispensed from such a container by the action of tipping the container so that one or more of the tablets fall, slide or roll out of the opening of the container by the action of gravity.

A disadvantage of such containers is that on dispensing excess tablets can inadvertently spill out of the container, causing the user the inconvenience of having to return excess tablets to the container, and possibly causing loss or contamination of such excess tablets if for example they fall onto the floor.

This invention provides a container for tablets which in part at least overcomes these disadvantages of known containers. Other objects and advantages of the invention will be apparent from the following description.

According to this invention a container, suitable for containing and dispensing tablets has one or more dispensing openings, characterised by the dispensing opening and/or a dispensing passage upstream of the dispensing opening being constricted or obstructed such that a tablet passing along the dispensing passage is releasably retained by the constriction or obstruction with part of the tablet projecting outside the dispensing opening, the dispensing opening being defined by a rim which wholly or partly surrounds the dispensing opening, part of the said rim or an adjacent part of the container being moveable relative to the rest of the container so as to facilitate the release of the retained tablet from the container.

The terms "upstream" and "downstream" used herein refer to the direction, termed herein the "dispensing direction", in which the tablets travel from the interior of the container towards and then through the dispensing opening.

Such retention of the tablet in the dispensing passage with part of the tablet projecting outside the dispensing opening provides the advantage that the retained tablet blocks the passage and prevents excess tablets from passing through the dispensing package, thereby preventing spillage of tablets. Additionally this releasable retention facilitates the user's access to the tablet and allows the user to grip the projecting part of the tablet and withdraw the entire tablet from the dispensing opening without having to catch a falling or rolling tablet. This reduces the possibility of accidental dropping of the tablet. The provision of a part of the rim or the adjacent part of the container being moveable relative to the rest of the container facilitates removal of the tablet from the container. Release of the tablet from the container may be facilitated by exposure of more of the tablet outside the container than is the situation before the said part of the rim or the adjacent part of the container is so moved, and/or movement of the tablet beyond the restrained caused by the said constriction or obstruction.

The tablets which can be dispensed by the container of this invention may be pharmaceutical formulations, e.g. tablets for oral administration, confectionery, e.g. sweets, or other tablets.

The container of this invention is particularly suitable for tablets which have a shape which is flattened about a plane. Shapes which are flattened about a plane include circular discs, oval discs, tetragonal shapes, parallelogram shapes, oblate spheroids etc. A particular shape flattened about a plane is a circular disc, for example with beveled edges.

Suitably the cross-sectional shape of the dispensing opening(s), about the dispensing direction corresponds substantially to the cross sectional shape of the tablet about the dispensing direction. For example in the case of tablets which are a disc, tetragonal or parallelogram shape the dispensing opening may suitably be a slot shape opening, i.e. having a width greater than its height, suitably a rectangular slot shaped opening, optionally with rounded corners or one or more rounded ends, e.g. a lozenge shape opening.

Suitably the dispensing opening may be defined as the extremity of a dispensing passage defined by dispensing passage-defining walls which terminate in the said rim of the dispensing opening and which define the dispensing passage between these walls upstream of the dispensing opening. The passage-forming walls may taper, narrowing from the interior of the container toward and to form the rim of the dispensing opening. Such a tapering dispensing passage may assist in guiding and orienting tablets toward the dispensing opening. The guiding and orienting of the tablets may ensure that the tablets pass along the dispensing passage and enter the dispensing opening in a preferred alignment so that inter alia interlocking of tablets which can cause jamming is wholly or partly reduced.

The dispensing opening and/or the dispensing passage may be constricted or obstructed by for example one or more obstructions in the dispensing opening and/or the dispensing passage, a converging of the rim of the opening, and/or the passage-forming walls, or by means of projections inwardly from the rim of the dispensing opening or from the inner surface of the dispensing passage, e.g. ridges, small surface bumps or other surface convexities. Such inwardly directed projections may for example be resilient, so that they retain the tablet by means of their resilience, but from which retention the tablet can be easily removed. Alternatively they may be non resilient. The dispensing opening and/or the dispensing passage may be constricted or obstructed by for example a combination of two or more such types of constriction or obstruction. For example the passage forming walls may be made of plastics materials. Other methods of constricting or obstructing the opening and/or passage will be apparent to those skilled in the art.

The constriction or obstruction should provide a narrowing of the dispensing opening and/or the dispensing passage to less than the width, e.g. diameter of a circular tablet, and/or to less than the thickness of a tablet, such that half or less of the tablet projects from the dispensing opening when the tablet is retained in the dispensing opening. Suitably the constriction or obstruction may be located at the dispensing opening, or immediately in front (downstream) of the dispensing opening, or in the dispensing passage upstream of the dispensing opening. When the constriction or obstruction is located in the dispensing passage the constriction or obstruction should suitably be located, relative to the length of the dispensing passage, within one tablet width, or one radius in the case of circular tablets, of the dispensing opening to ensure that part of the tablet projects from the dispensing opening.

In one form of constriction or obstruction suitable for a slot-shaped opening, the height of the slot may be greater than the thickness of the tablets, but the width of the slot is less than the width of a tablet, e.g. the diameter of a circular tablet. Alternatively in another form of constriction or obstruction suitable for a slot-shaped opening, the height of the slot may be less than the thickness of the tablets, but the width of the slot is greater than the width of a tablet, e.g. the diameter of a circular tablet. Upstream of the dispensing opening the dispensing passage may widen away from the above-described slot shape into a passage corresponding generally to the shape of the tablets in the plane in which they are flattened, e.g. in the case of circular tablets, into a cylindrical dispensing passage.

The part of the said rim or adjacent part of the container which is moveable relative to the rest of the container may be so moveable in a number of alternative or combinations of ways. In one way the part of the said rim or adjacent part of the container may fold about a hinge or other type of pivot relative to the rest of the container, so as to expose more of the tablet outside the container so as to facilitate release of the tablet.

Alternatively the said part of the said rim or adjacent part of the container may be slideably moveable relative to the rest of the container. The said part of the said rim or adjacent part of the container may be slideably moveable in the dispensing direction.

In one embodiment of this invention the dispensing opening may be substantially a rectangular slot-shape, with a height, i.e. the short dimension of the rectangle, being greater than the thickness of the tablets to be dispensed, the width of the dispensing opening being narrowed to less than the width of the tablets to be dispensed by means of a constriction or obstruction as described above being on a part of the rim which is moveable, suitably slideably moveable, in the general dispensing direction of the tablets.

The above described movement of the said part of the said rim or adjacent part of the container may serve to carry the releasably retained tablet thereupon so as to thereby expose more of the tablet outside of the container.

Suitably the said part of the said rim or adjacent part of the container may have upper and lower parts, in the general form of upper and lower lips or jaws, with the constriction or obstruction being on the lower part, and the lower part of the rim being slideably moveable in the dispensing direction. Such a construction may enable the lower jaw or lip to slide in the dispensing direction and to carry the releasably retained tablet thereupon so as to expose more of the tablet outside the container.

Methods of making the part of the rim moveable, e.g. slideably moveable relative to the container will be apparent to those skilled in the art. For example the moveable part of the rim may be included in, suitably integrally as part of, a slideably moveable part which fits within a container body and which may have projections thereon which cooperate with guide grooves in the container body wall or vice versa. Alternatively the part of the rim may be included in, suitably integrally as part of, a part which fits around a container body in the manner of a sleeve and which may have projections thereon which cooperate with guide grooves in the container body wall. However the relative moveability is achieved. the relatively moveable parts may include end-stops of a type apparent to those skilled in the art to prevent complete detachment of the rim wall from the container.

By such constructions of the container of this invention the tablet being dispensed may be retained by the constriction or obstruction formed by the projection(s), and then may be grasped by the user and pulled in the general direction of dispensing such that the lower part moves, e.g. slides, relative to the container and thereby facilitate the release of the tablet, for example to allow the tablet to be lifted from the lower part. Alternatively the part of the rim or the adjacent part of the container which is moveable may be grasped and pulled, so as to release the tablet. For example as the lower part moves this action may carry the tablet beyond the retention caused by the constriction or obstruction, of the dispensing opening and thereby facilitate the removal of the tablet from the dispensing opening. Tablets which have a shape which is flattened about a plane, as described above, are particularly easy to grasp with a finger and thumb on either side of the plane and so to be lifted out.

Suitably the relative moveability of the container and the part of the said rim or an adjacent part of the container may be used to provide an anti-jamming mechanism to prevent or reduce jamming of tablets in the dispensing passage and/or dispensing opening. For example a projection may be included on one of the relatively moveable parts, which when the said parts are in relative motion can engage with tablets in the dispensing opening and/or dispensing passage to apply a force to them, which can urge them out of any jamming interaction which may occur.

In one embodiment of such a construction, if the passage-forming walls taper and narrow toward and to form a slot shaped dispensing opening as described above, then the passage-forming wall may include an aperture, e.g. a slit. and there may be a corresponding projection into the container from the rim which is also slideably moveable so that the movement of the rim causes the projection to pass through the aperture and engage with the tablets to un-jam them.

Alternatively or additionally the container may be separately provided with a tool for releasing jammed tablets, for example a probe, which may be provided as an integral part of a removeable cap.

Suitably the container of the invention may include one or more such dispensing openings and corresponding dispensing passages.

The overall container itself may be of any convenient shape. The container may suitably be of a sectional shape which corresponds closely to the shape of the tablets contained within it, but with sufficient internal clearance between tablets and the internal face of the container wall to reduce the possibility of jamming of the tablets within the container during dispensing.

For example in the case of circular disc-shaped tablets the container may be of a generally cylindrical internal section, of a diameter such that tablets therein can easily move along the container toward the dispensing opening without jamming. Within a cylindrical container circular disc-shaped tablets will normally be stored with their disc plane perpendicular to the axis of the cylinder. The dispensing passage may be so shaped as to taper from the circular section of the cylindrical container toward the shape of the dispensing opening. If the dispensing opening is in the shape of a generally rectangular slot, as discussed above, then the dispensing passage may be so shaped as to flip the tablets through 90° from their storage alignment as they travel in the dispensing direction toward the dispensing opening so that they present their section perpendicular to the disc plane to the dispensing opening.

The dispensing opening(s) and the passage-defining walls, may for example be formed integrally with the overall container. Alternatively the dispensing opening(s) and the dispensing passage-defining walls may for example be formed separately in a separate cap, adapter or dispensing part to be attached to the neck of a container body, to form a container of the invention. Such a separate cap, adapter or dispensing part, attachable to the neck of a container body, forms a further aspect of this invention. Such a container body may suitably comprise a conventional bottle, tube or other type of package for tablets.

The dispensing opening(s) of the container may conveniently be provided with closures which may be of an conventional known type, for example a hinged closure having a snap-fit closure action, or a removable closure, and the closure may suitably be of a known child-proof type.

The invention will now be described by way of example only with reference to the following drawings.

Figure 1:
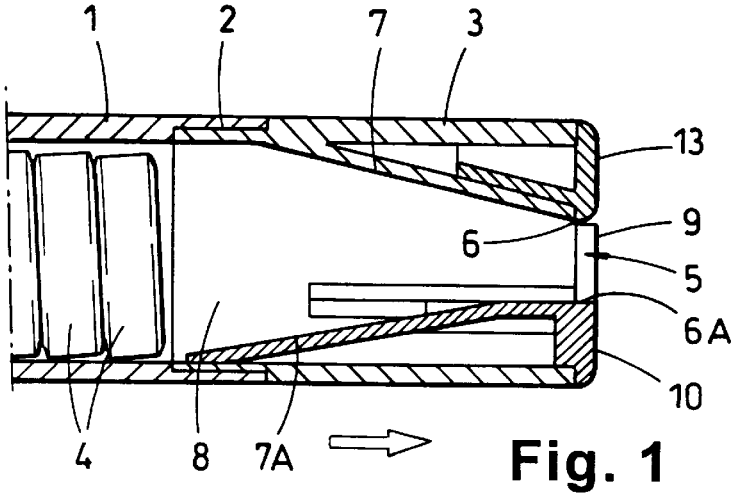
FIGS. 1–6 show the construction of a container of the invention.
Figure 2:
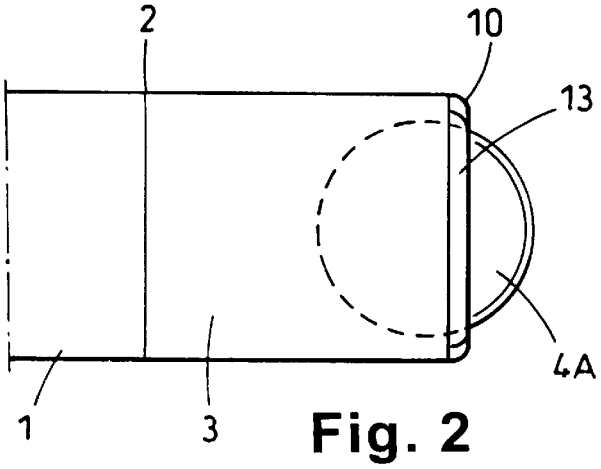
Figure 3:
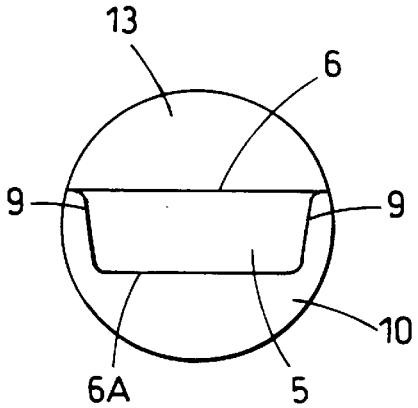
Figure 4:
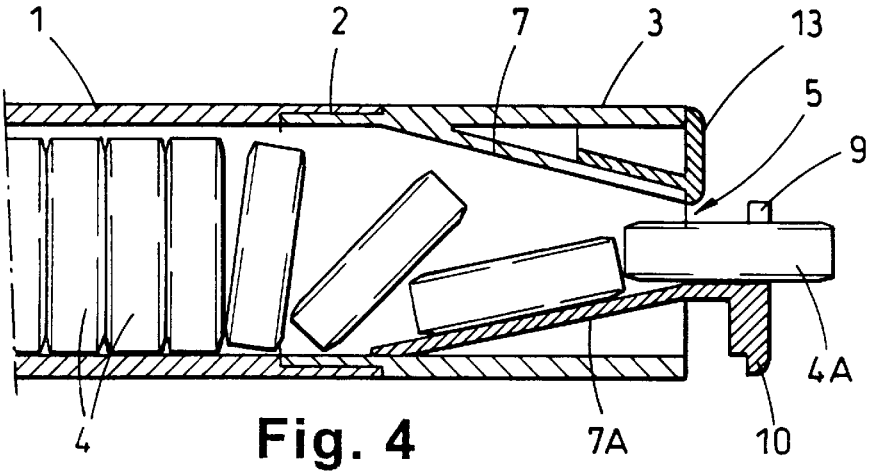
Figure 5:
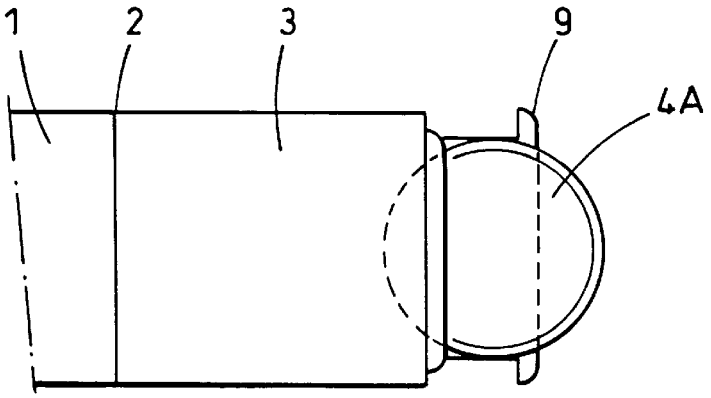
Figure 6:
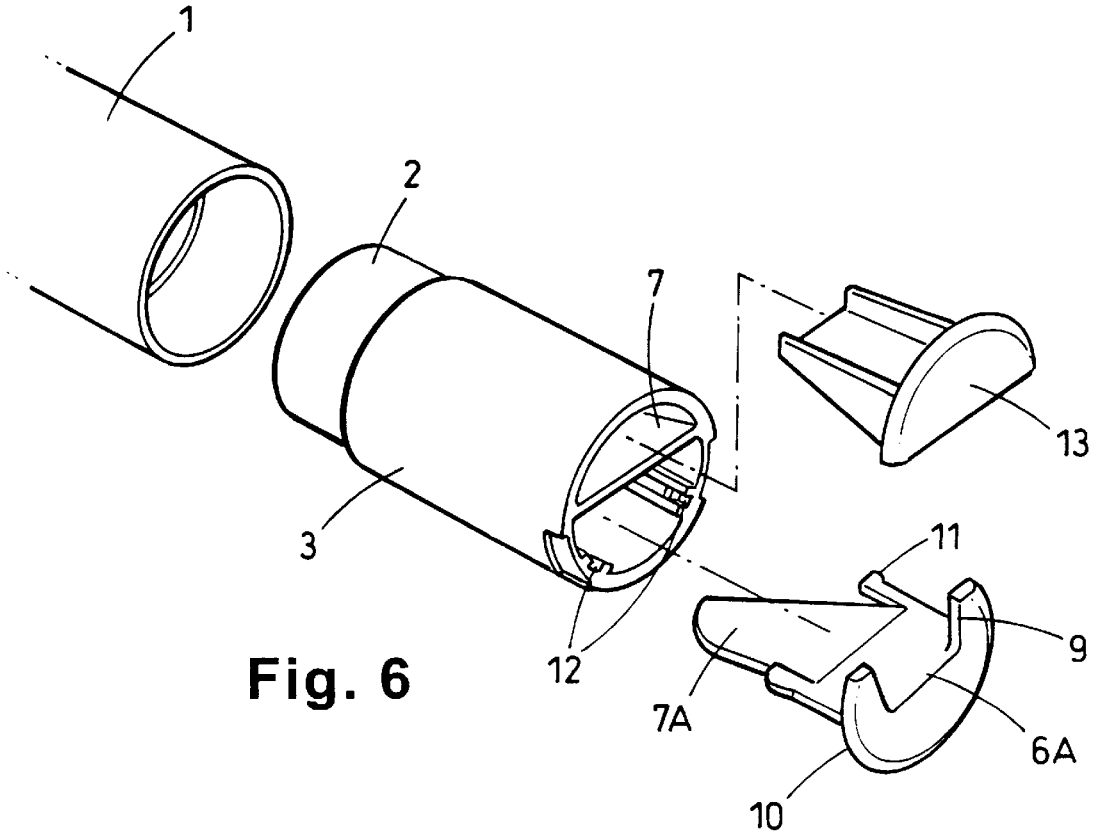

Referring to FIGS. 1 to 6, a container of the invention is shown in longitudinal sectional views in FIGS. 1 and 4, in FIG. 3 in an end view from the direction of the right as shown in FIG. 1, in plan views in FIGS. 2 and 5, and in an exploded view in FIG. 6.

The container comprises a cylindrical container body 1 (only the dispensing end region is shown) to which is attached by a friction fit at 2 an adapter 3. The container body 1 contains circular disc shaped tablets 4. At one end of the container, in the adapter 3, is a dispensing opening 5 which as shown in FIG. 3 is a slot shape, defined by a rim 6. The rim 6 is the extremity of passage forming walls 7 which define a dispensing passage 8 which tapers from the circular section of the container body 1 toward the dispensing opening 5.

The dispensing opening 5 is constricted by inwardly directed projections 9, so that immediately upstream of the projections 9 the width of the dispensing passage 8 is wider than the diameter of the tablets 4. but at the dispensing opening 5 the width of the slot at 5 is less than the diameter of the tablets 4.

The lower part 6 of the rim 6, and the adjacent part of the passage forming walls 7A are slideably moveable within the adapter 3 in the general dispensing direction shown by the arrow in FIG. 1. This is achieved by their being made in the form of an insert 10, having projecting parts 11 which slideably engage with corresponding grooves 12 in the adapter 3, the grooves 12 having end stops which prevent the insert from being entirely withdrawn from the adapter.

The end of the adapter 3 may be closed by a plug 13. The slot 5 may be collapsible by a closure (not shown) or other conventional means, and the entire end shown of the adapter may be closed by a conventional closure.

In use, with the insert 10 in the position shown in FIG. 1, the container may be tipped or shaken so that tablets 4 travel along the dispensing passage 8 and are aligned with the slot 5. As they attempt to pass through the slot 5 they are retained by the projections 9 so that, as shown in FIG. 2, part 4A of the tablet 4 projects outside the dispensing opening. The tablet 4, or alternatively the insert 10 may then be pulled in the direction of the arrow in FIG. 1, into the position shown in FIGS. 4 and 5, thereby carrying the tablet 4 into a position where more of the tablet 4 is exposed outside of the container, relative to the situation shown in FIG. 2. and where release of the tablet 4 by lifting, upwardly as shown in FIG. 4 is thereby facilitated. The insert 10 may then be returned to the position shown in FIG. 1 and the operation repeated to dispense a second and further tablets.

Figure 7:
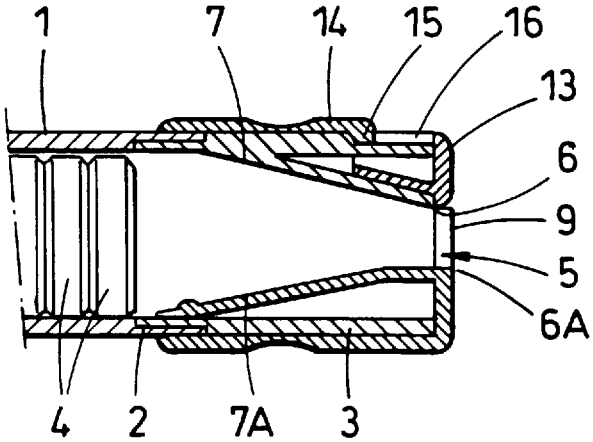
FIGS. 7–10 show the construction of an alternative container of the invention.
Figure 8:
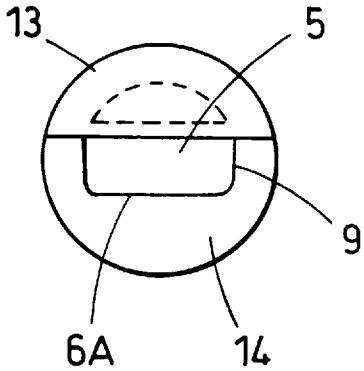
Figure 9:
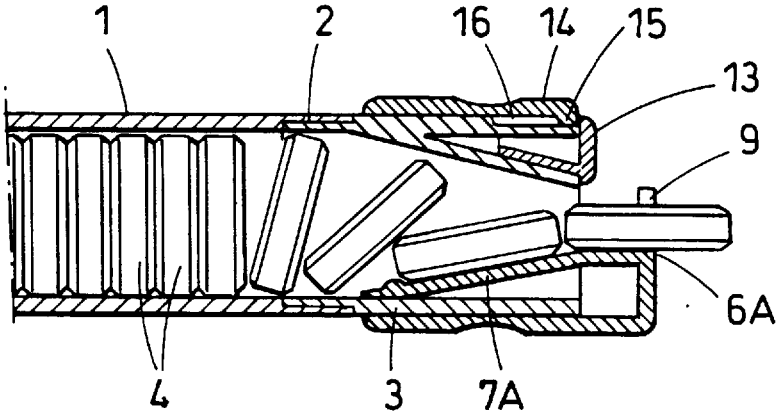
Figure 10:
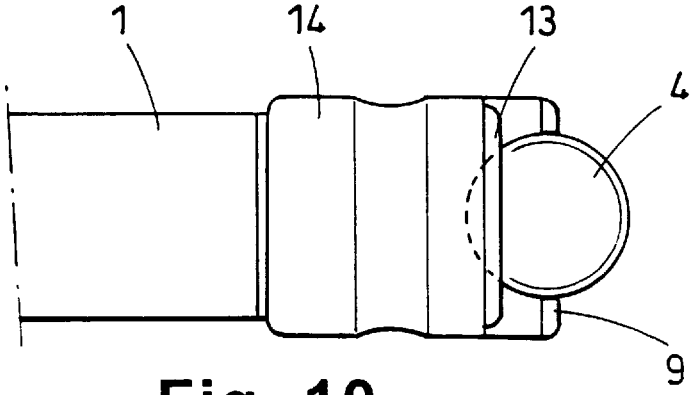

Referring to FIGS. 7–10 an alternative container of the invention is shown in longitudinal sectional views in FIGS. 7 and 9, in FIG. 8 in an end view from the direction of the right as shown in FIG. 7, and in FIG. 10 a plan view of the container as shown in FIG. 9.

Parts having a similar identity to parts shown in FIGS. 1–6 are numbered as in FIGS. 1–6.

In the container of FIGS. 7–10, the adapter 3 is surrounded by a sleeve 14 which is longitudinally slideable on the adapter 3, the limits of slideable travel of the sleeve 14 being determined by the limits of movement of a projection 15 on the sleeve 14 within a groove 15 in the adapter, an arrangement which also restricts rotation of the sleeve on the adapter 3.

The lower part 6A of the rim 6, and the adjacent part of the passage forming walls 7A are integrally parts of the sleeve 14, and are consequently slideably moveable within the adapter 3 in the general dispensing direction shown by the arrow in FIG. 7. The overall construction of the dispensing opening 5 of the container of FIGS. 7–10, is similar to that of FIGS. 1–6.

In use, with the sleeve 14 in the position shown in FIG. 7, the container may be tipped or shaken so that tablets 4 travel along the dispensing passage 8 and are aligned with the slot 5. As they attempt to pass through the slot 5 they are retained by the projections 9 so that, in a manner analogous to that shown in FIG. 2, part of the tablet 4 projects outside the dispensing opening. The tablet 4, or alternatively the sleeve 14 may then be pulled in the direction of the arrow in FIG. 7, into the position shown in FIGS. 9 and 10, carrying the tablet 4, and where release of the tablet 4 by lifting, upwardly as shown in FIG. 9 is facilitated. The insert 14 may then be returned to the position shown in FIG. 7 and the operation repeated to dispense a second and further tablets.

Figure 11:
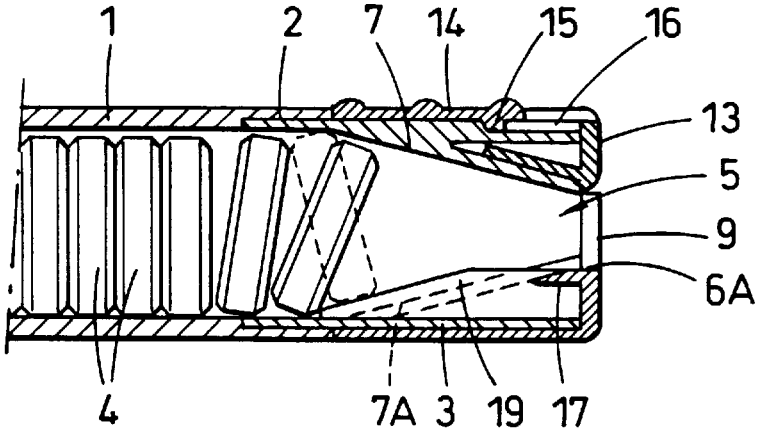
FIGS. 11–13 show the construction of a container of the invention having an anti-jamming mechanism.
Figure 12:
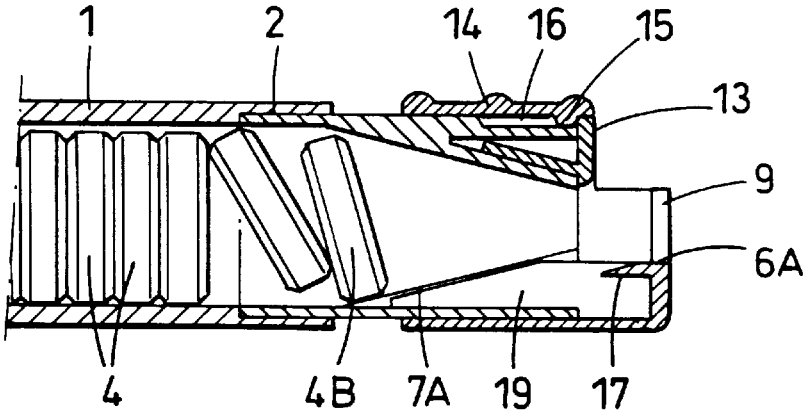
Figure 13:
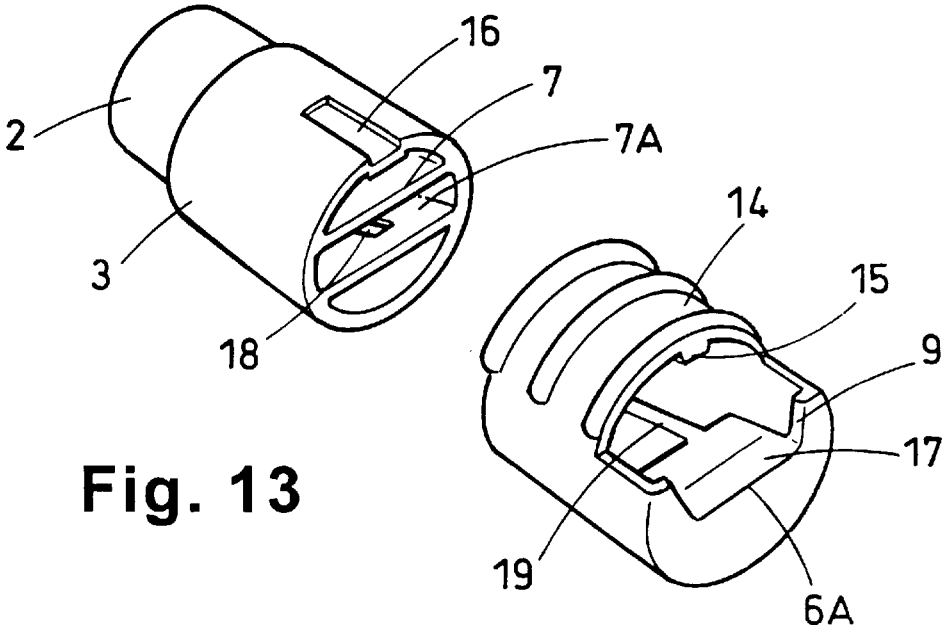

Referring to FIGS. 11–13, a container is shown which in general construction and operation is identical to that of FIGS. 7–10, having a sleeve 14 surrounding the adapter 3, and parts having a similar identity to parts shown in FIGS. 7–10 are numbered as in FIGS. 7–10. FIGS. 11 and 12 show sectional views and FIG. 13 shows an exploded view (plug 13 is not shown in FIG. 13).

The container of FIGS. 11–13 differs from FIGS. 7–10 in that part of the lower part of the passage forming wall 7A is integrally formed with the adapter 3. The sleeve 14 also includes a part 17 of the passage forming wall, which when the adapter 3 is in the non-extended position shown in FIG. 11 largely fits underneath the wall 7A with a small part extending in front of the wall 7A. In the wall 7A is aperture in the shape of a slit 18, and extending from the part 17 is a projection 19 in the form of a fin, which when the adapter 3 is in the non-extended position shown in FIG. 11 passes through the slit 18. In FIGS. 11 and 12 parts of the wall 7A which are occluded by the fin 19 are shown with broken lines.

The overall operation of the container of FIGS. 11–13 is identical to that of the container of FIGS. 7–10, except that as shown in FIGS. 11 and 12 as the sleeve 14 is reciprocally moved on the adapter 3 the fin 19 passes through the slit 18 to engage with and un-jam the tablet 4B and move it into the un-jammed position 4B.

All parts of the containers of FIGS. 1–13 are made of resilient plastics materials common in the art of container manufacture. The container may also be made with the parts illustrated as being in the adapter instead being of integral construction, the container for example being filled from the end opposite to the dispensing opening.

We claim:

1. A container (1), suitable for containing and dispensing tablets (4), having one or more dispensing openings (5) being defined by a rim (6) which wholly or partly surrounds the dispensing opening (5), the dispensing opening (5) and/or a dispensing passage (8) upstream of the dispensing opening (5) being constricted or obstructed such that a tablet (4) passing along the dispensing passage is releasably retained by the constriction or obstruction (9), characterised in that part of the retained tablet (4) projects outside the dispensing opening (5), part of the said rim (6) or an adjacent part of the container (1) being moveable relative to the rest of the container (1), and the said part on moving carries the releasably retained tablet thereon so as to expose more of the retained tablet outside the container, and holds the said tablet, with a part of the tablet projecting from the said moveable part, and in a position such that the user can grasp the tablet and remove the tablet from the said part, so as to facilitate the release of the retained tablet (4) from the container.

2. A container according to claim 1 characterised in that the cross-sectional shape of the dispensing opening(s) (5), about the dispensing direction corresponds substantially to the cross sectional shape of the tablet (4) about the dispensing direction.

3. A container according to claim 2 characterised in that the dispensing opening (5) is a slot shape opening.

4. A container according to claim 1 characterised in that the dispensing opening (5) is defined as the extremity of a dispensing passage (8) defined by dispensing passage-defining walls (7) which terminate in the said rim (6) of the dispensing opening (5) and which define the dispensing passage between these walls upstream of the dispensing opening (5), and which taper, narrowing toward and to form the rim of the dispensing opening (5).

5. A container according to any one of the preceding claims characterised in that the constriction or obstruction (9) provides a narrowing of the dispensing opening (5) and/or the dispensing passage (8) to less than the width and/or to less than the thickness of a tablet (4), such that half or less of the tablet (4) projects from the dispensing opening (5) when the tablet (4) is retained in the dispensing opening (5).

6. A container according to claim 5 characterisea in that the dispensing opening (5) is slot shaped, the height of the slot being greater than the thickness of the tablet (4), but the width of the slot is less than the width of a tablet (4).

7. A container according to claim 1 characterised in that the said part of the said rim (6) or adjacent part of the container is slideably moveable relative to the rest of the container (1) in the dispensing direction.

8. A container according to claim 7 characterised in that the dispensing opening (5) is substantially a rectangular slot-shape, with a height, i.e. the short dimension of the rectangle, being greater than the thickness of the tablets to be dispensed, the width of the dispensing opening (5) being narrowed to less than the width of the tablets to be dispensed by means of a constriction or obstruction (9) on a part of the rim (6) which is slideably moveable in the dispensing direction of the tablets (4).

9. A container according to claims 7 or 8 characterised in that the said part of the said rim (6) or adjacent part of the container has upper and lower parts, in the general form of upper and lower lips or jaws, with the constriction (9) or obstruction being on the lower part, and the lower part of the rim being slideably moveable in the dispensing direction.

10. A container according to claim 1 characterised in that the relative moveability of the container and part of the said rim or an adjacent part of the container is used to provide an anti-jamming mechanism to prevent or reduce jamming of tablets (4) in the dispensing passage and/or dispensing opening (5).

* * * * *